US006253965B1

(12) United States Patent
Pitocco

(10) Patent No.: US 6,253,965 B1
(45) **Date of Patent: *Jul. 3, 2001**

(54) VALVE HEADS FOR SOFT DRINK BOTTLES AND THE LIKE

(75) Inventor: Roberto Jose Pitocco, Buenos Aires (AR)

(73) Assignee: Sides S.A. (AR)

( * ) Notice: Subject to any disclaimer, the term of this patent is extended or adjusted under 35 U.S.C. 154(b) by 0 days.

This patent is subject to a terminal disclaimer.

(21) Appl. No.: 09/513,946

(22) Filed: Feb. 28, 2000

(51) Int. Cl.[7] ..... B67B 5/00

(52) U.S. Cl. ..... 222/153.07; 222/394; 222/402.15; 222/505

(58) Field of Search ..... 222/505, 518, 222/394, 402.1, 402.15, 153.06, 153.07

(56) References Cited

U.S. PATENT DOCUMENTS

| | | | | |
|---|---|---|---|---|
| 4,467,931 | * | 8/1984 | Gach | 222/153 |
| 4,660,748 | * | 4/1987 | Hagan | 222/518 |
| 4,763,801 | * | 8/1988 | Nycz | 215/203 |
| 4,860,932 | * | 8/1989 | Nagy | 222/518 |
| 4,995,534 | * | 2/1991 | Norman | 222/518 |
| 5,350,090 | * | 9/1994 | McClure | 222/518 |
| 5,447,257 | * | 9/1995 | Dark | 222/518 |
| 5,551,605 | * | 9/1996 | Bethlendy | 222/518 |
| 5,875,907 | * | 3/1999 | Lay | 222/153.06 |
| 5,918,779 | * | 7/1999 | Ventura | 222/518 |
| 6,036,170 | * | 3/2000 | Pitocco | 251/99 |
| 6,095,379 | * | 8/2000 | Martinez et al. | 222/518 |

* cited by examiner

*Primary Examiner*—Kevin Shaver
*Assistant Examiner*—David Deal
(74) *Attorney, Agent, or Firm*—Bachman & LaPointe, P.C.

(57) ABSTRACT

Improvements in valve heads for soft drink bottles and the like, of the kind which may be coupled to the neck of a bottle containing carbonated liquid, including a valve body crossed by a liquid circulation channel communicating an outer spout with the inner outlet of a dip tube which ends inside the bottle; a check valve which, mounted in the circulation channel, has a normally closed valve blocker the stem of which has a sliding guide in the upper portion of the valve body; the improvements comprising a covering hood having substantially a frustoconical shape, a command element constituting a second genus lever, a removable band constituting a folding strap for the foldable articulated arm, a mouth constituting a passage for the outer spout, and connecting element between the hood and the valve body.

6 Claims, 1 Drawing Sheet

VALVE HEADS FOR SOFT DRINK BOTTLES AND THE LIKE

FIELD OF THE INVENTION

The instant invention relates to improvements in valve heads for soft drink bottles and the like, comprising a head requiring a small mass of forming material, thus being much lighter and economical, and which may be used as a disposable means.

BACKGROUND OF THE INVENTION PRIOR ART

Siphons supplying carbonated water (soda) use dispenser valve heads which, normally, comprise a valve body crossed by a circulation channel. This channel, at one end, ends in a dispenser outer spout, while at the other ends into a dip tube located inside the bottle.

In general, the valve body is formed by the head walls, therefore this kind of head has a large volume and require a large mass of material for its manufacture.

Further, in order to allow dispensing of the liquid contained into the bottle, a check valve is included into this circulation channel, which is actuated by means of a rigid lever projecting outwardly from the valve head. Therefore, this kind of rigid lever is the means used typically by conventional valve heads.

On the other hand, by means of the improvements of the instant invention, a head is obtained the valve body of which is covered by a covering hood having a diametrical slot, constituting an operating channel for command thereof. The latter, being intended to hold a check valve, has its fulcrum in said covering hood and comprises an articulated arm which is foldable over the covering hood, wherein folding stops and a folding straps are located for retaining the end of the arm which partially closes said diametrical slot.

This constitution of the head affords a better operation and requires a smaller mass of constituting material, which makes the head lighter and less expensive. In fact, the valve body does not act as a support for the command means, therefore, the latter is reduced to its minimum possible expression. This simplification of the valve body is compensated by the presence of a covering hood protecting it from shocks and dirt.

Further, the instant covering hood is designed for serving as mounting means for a command means the articulated arm of which is foldable on said hood, where it has folding stops and a strap retaining its end. The inclusion of a diametrical slot allows fixing the strap and unfolding the articulated arm.

The smaller base of the hood and the cited stops prevent the folding articulated arm from being pressed in by any accidental pressure, in which case the valve stem would be displaced and an undesirable delivery of liquid would take place. Therefore, frequent shocks and pressures produced during storage and loading and unloading of trucks may not actuate the command means which is folded inside the diametrical slot and also properly strapped.

The perfect compatibility between the forming elements is demonstrated by the engagement between the valve body and the covering hood, since they not only have connecting means therebetween, but, further, the hood has a side mouth. This mouth, originated at the edge of the open larger base, allows the passage of the outer spout through which the carbonated liquid is delivered.

BRIEF DESCRIPTION OF THE DRAWINGS

A preferred embodiment of the invention will be now described, as an example without limiting the scope thereof, in connection with the attached drawings in which.

In the figures, the same reference numerals designate the same or equivalent parts, and assemblies of several elements are indicated with letters.

Figure 1:
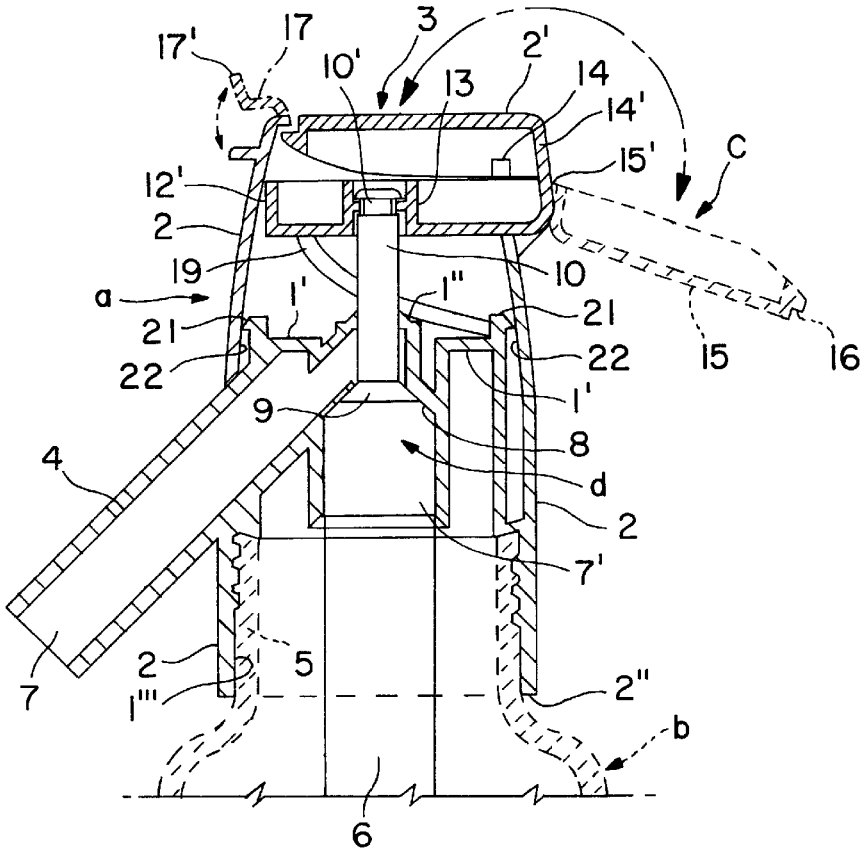
FIG. 1 is a longitudinal section of the valve head showing its constitution and forming elements.

Main References (a) covering hood
(b) bottle
(c) command means
(d) check valve
(1) valve body
(1') upper part of the valve body (1)
(1") valve (d) stem (10) sliding guide
(1"') lower portion of the valve body (1).
(2) side walls of the covering hood (a).
(2') smaller base of the hood (a) partially closed.
(2") larger open base of the hood (a).
(3) diametrical slot of the hood (a).
(3') end of the diametrical slot (3) which may be blocked.
(3") unfolding end of the diametrical slot (3)
(4) head (a) spout
(5) neck of the bottle (b)
(6) dip tube
(7) liquid circulation channel
(7') outlet of channel (7) into the dip tube (6)
(8) valve seat in the circulation channel (7)
(9) valve blocker of the check valve (d)
(10) check valve (d) stem
(10') stem (10) end
(11) head end of the valve body (1)
(12) main body of the command means (c)
(12') support articulation
(13) stop of main body (12) for end (10')
(14) folding stops of the articulated arm (15)
(14') wings forming the folding stops (14)
(15) foldable articulated arm
(15') articulation defined by the hinged section narrowing
(16) end of the foldable articulated arm (15)
(17) removable folding strap
(17') handle of the removable folding strap (17)
(18) retention opening
(19) resilient elongated elements [compression resilient means]
(20) mouth for passage of the spout (4)
(21) annular tooth of the valve body (1) [connecting means]
(22) inner annular shoulder of the good (a) [connecting means]

DETAILED DESCRIPTION OF THE PREFERRED EMBODIMENT

The improvements in valve heads for soft drink bottles and the like, of the kind which may be coupled to neck (5) of a bottle (b) containing carbonated liquid, include:

a) a valve body (1) crossed by a liquid circulation channel (7) communicating an outer spout (4) with the inner outlet (7') of a dip tube (6) which ends inside the bottle (b);

b) a check valve (d) which, mounted in said circulation channel (7), has a normally closed valve blocker (d) the stem of which (10) has a sliding guide (1") in the upper portion (1') of said valve body (1); said improvements being characterized by comprising:

c) a covering hood (a) having substantially a frustoconical shape, the upper portion (1') of said valve body (1) fitting into the larger open base (2"), while the partially closed smaller base (2') has a diametrical slot (3) the ends of which (3') (3"), exceeding said smaller base (2'), pass through part of the side walls (2) of said covering hood (a);

d) a command means (c) which, connected to said valve blocker (d), and having its fulcrum (12') at the side walls (2) of said covering hood (a), constitutes a second genus lever the resistance of which is given by a compression resilient means (19), while the power is given by an articulated arm (15) foldable within the limits of said covering hood (a) and unfoldable through said diametrical slot (3);

e) a removable band which, partially blocking said diametrical slot (3), constitutes a folding strap (17) for said foldable articulated arm (15);

f) a mouth (20) which, affecting the side walls (2) of said covering hood (a), constitutes a passage for said outer spout (4); and g) connecting means (21, 22) between said hood (a) and said valve body (1).

Generally speaking, the improvements of the instant invention result in a valve head the valve body (1) of which is covered by a hood (a) having a diametrical slot (3) for unfolding a command means (c) which, intended for a check valve (d), has its fulcrum (12') in said hood (a). This command means (c) comprises an articulated arm (15) which is foldable over the hood (a), where folding stops (14) and a folding strap (17) are located which, partially blocking the diametrical slot (3), retain its end (16). [See FIGS. 1 and 3].

More particularly, the instant valve head comprises a valve body (1) having an upper portion (1') and a lower portion (1'"). In the lower portion (1'") a coupling is defined for tight seal with the neck (5) of a bottle (b) containing carbonated liquid.

Towards one of its sides, the valve body (1) forms an outer dispensing spout (4) communicating with a dip tube (6) situated within the bottle (b) by means of the circulation channel (7) for carbonated liquid. Within the valve body (1), the circulation cannel (7) communicates the end of said spout (4) with an outlet (7') in the dip tube (6). [See FIG. 1]

A check valve (d) is mounted into the circulation channel (7) such that its blocker (9) is normally closed against a valve seat (8) formed by the circulation channel (7). Above the circulation channel (7) and the valve seat (8), the valve body (1) has an upper portion (1') provided with a sliding guide (1") of stem (10 of the check valve (d). This stem (10) extends vertically and ends in an end (10') which is connected to a retention stop (13) of the command means (c) [See FIG. 1]

On the other hand, over the upper portion (1') of the valve body (1) a substantially frustoconical covering hood (a) is mounted, having an open larger circular base (2") and a partially closed smaller circular base (2'), between which the side walls (2) draw a smooth curve, convex outwardly.

The open larger base (2") of the hood (a) fits into the upper portion (1') of the valve body (1), to which it is connected through corresponding connecting means (21,22). The cited connecting means is comprised by an annular tooth (21) at the upper portion (1') of said valve body (1) and by an annular shoulder (2) formed at the interior by the side walls (2) of the hood (a). Further, side walls (2) have a mouth (20) which, originated from the edge of the open larger base (2"), intended for fitting the spout (4) of the valve body (1). [See FIG. 2]

Figure 3:
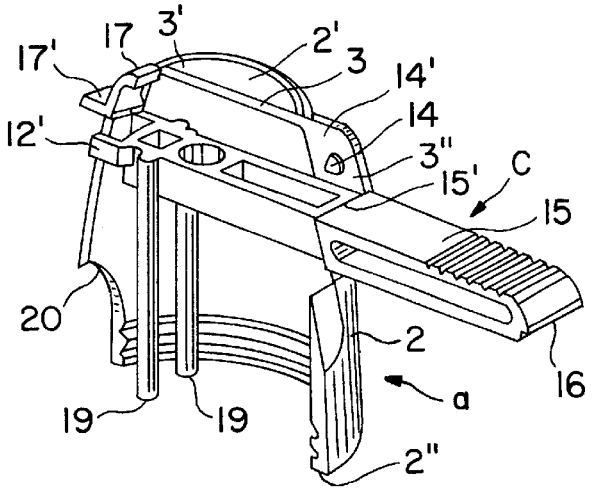
FIG. 3 is a longitudinal perspective section of the covering hood, having the command means mounted thereto.

At the opposite end of the open larger base (2"), the partially closed smaller base (2") has a diametrical slot (3) the ends of which (3', 3"), exceeding said smaller base (2'), pass through part of side walls (2) of said hood (a). [See FIG. 3]

Figure 2:
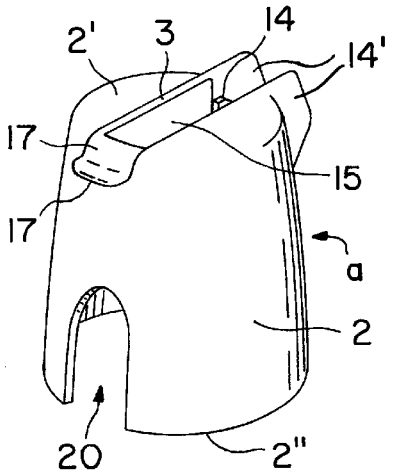
FIG. 2 is a perspective view of the covering hood showing its general conformation.

Within the hood (a) the command means (c) is located an comprised by a main body (12) which, at one of its ends, has a support fulcrum (12'), while the opposite end comprises a foldable articulated arm (15), which is foldable within the limits of the hood (a) and unfoldable through the diametrical slot (3) [See FIG. 2].

At the lower portion, the main body (12) of the command means (c) has said retention stop (13) for the end (10') of stem (10) and, further, a compression resilient means comprised by a set of elongated elements (19) projecting downwards, being resiliently compressed between said command means (c) and the upper portion (1') of the valve body (1). [See FIGS. 1 and 3]

In this way, the command means (c) constitutes a second genus lever the resistance of which is given by the elongated resilient elements (19) and the power of which is given by the foldable articulated arm (15).

In the present embodiment, the command means (15) is made of plastics, while the articulation of the foldable arm (15) is defined by a hinged sectional narrowing (15').[See FIGS. 1 an 3]

Concerning the diametrical slot (3), on one side, it ends at an end (3") passing through part of the side walls (2) of the hood (a), thus forming an opening for unfolding the foldable arm (15). At the opposite end, the diametrical slot (3) ends at an end (3') which may be blocked by a folding strap (17) comprised by a removable strap forming a retention for the end (16) of the foldable articulated (15). Further, this folding strap (17) has a command handle (17') [See FIGS. 1 and 2]

Further, from the edges of the unfolding end (3") of the diametrical slot (3), corresponding wings (14') are projected, constituting corresponding shoulders which form folding stops (14) for the foldable articulated arm (15).

Alternative embodiments of the invention have been foreseen in which the strapping means include a coupling strap (21) between the base (3) walls of the valve body (1) and neck (5) of bottle (b).

Operation of the Assembly

The covering good (a) allows, on one side, mounting the command means (c) and its strapping (17) and, on the other, covering the upper portion (1') of the valve body (1) preventing its exposition.

Further, the hinged sectional narrowing (15') or articulation permits folding of the articulated arm (15) against said hood (a). In this position it is retained by the folding strap (17) which, blocking an end (3') of the diametrical slot (3), prevents unfolding of end (16) of said articulated arm (15). [See FIG. 3]

Further, folding stops (14) located at the wings (14') bordering slot (3) prevent that the foldable arm (15) be pressed in due to any accidental pressure, in which case stem (10) of valve (d) would be displaced thus producing an undesirable delivery of liquid. [see FIG. 2]

Therefore, in order to dispense liquid, the folding strap (17) should be previously detached. In this way, the articulated arm (15) may be unfolded until it is displaced through de unfolding end (3") of the diametrical slot (3). In this way, once resistance of the resilient means (19) is overcome, the valve blocker (9) is displaced and liquid circulates through the corresponding channel (7) until it is released through the spout (4) of head (a). [See FIG. 3]

It is obvious that, upon practicing the invention, several modifications may be introduced in what concerns to construction details and shape, without departing from the basic principles of the invention which are clearly described in the appended claims.

What is claimed is:

1. Improvements in valve heads for bottles of the kind which may be coupled to the neck of a bottle containing carbonated liquid, including:

a) a valve body crossed by a liquid circulation channel communicating an outer spout with the inner outlet of a dip tube which ends inside the bottle;

b) a check valve which, mounted in said circulation channel, has a normally closed valve blocker the stem of which has a sliding guide in the upper portion of said valve body;

characterized by comprising:

c) a covering hood having substantially a frustoconical shape, the upper portion of said valve body fitting into the larger open base, while the partially closed smaller base has a diametrical slot the ends of which, exceeding said smaller base, pass through part of the side walls of said covering hood;

d) a command means which, connected to said valve blocker, and having its fulcrum at the side walls of said covering hood, constitutes a second genus lever the resistance of which is given by a compression resilient means, while the power is given by an articulated arm foldable within the limits of said covering hood and unfoldable through said diametrical slot;

e) a removable band which, partially blocking said diametrical slot, constitutes a folding strap for said foldable articulated arm;

f) a mouth which, affecting the side walls of said covering hood, constitutes a passage for said outer spout; and connecting means between said hood and said valve body.

2. Improvements in valve heads for bottles as claimed in claim 1, characterized in that the folding strap comprises a removable strap which, blocking an end of the diametrical slot, forms a stop for the end of the foldable articulated arm.

3. Improvements in valve heads for bottles as claimed in claim 1, characterized in that the covering hood has an open larger circular base and a partially closed circular base, between which the side walls draw a smooth curve, convex outwardly.

4. Improvements in valve heads for bottles as claimed in claim 1, characterized in that the compression resilient means comprise a set of elongated elements which, projected from the inner face of the command means, are resiliently compressed between said command means and the inner wall.

5. Improvements in valve heads for bottles as claimed in claim 1, characterized in that the command means forms a retention stop to which the end of the blocker stem is connected.

6. Improvements in valve heads for bottles as claimed in claim 1, characterized in that connecting means comprise an annular tooth at the upper portion of the valve body and an annular shoulder formed inside by the side walls of the covering hood.

* * * * *